United States Patent [19]

Majid et al.

[11] Patent Number: 4,867,755

[45] Date of Patent: Sep. 19, 1989

[54] PREPARATION OF COMPOSITE FUELS, WITH REDUCED SULFUR EMISSION CHARACTERISTICS, FROM OILY AND CARBONACEOUS WASTES

[75] Inventors: Abdul Majid, Ottawa; Vincent P. Clancy, Greely; Bryan D. Sparks, Gloucester, all of Canada

[73] Assignee: Canadian Patents & Development Ltd., Ottawa, Canada

[21] Appl. No.: 235,513

[22] Filed: Aug. 24, 1988

[30] Foreign Application Priority Data

Aug. 27, 1987 [CA] Canada ..... 545580

[51] Int. Cl.[4] ..... C10L 10/00

[52] U.S. Cl. ..... 44/604; 44/593

[58] Field of Search ..... 44/604, 26, 593, 624

[56] References Cited

U.S. PATENT DOCUMENTS

| | | | |
|---|---|---|---|
| 4,226,601 | 10/1980 | Smith | 44/26 |
| 4,302,207 | 11/1981 | Paspek | 44/604 |
| 4,387,656 | 6/1983 | Voss | 44/604 |
| 4,515,601 | 5/1985 | Charters | 44/604 |
| 4,661,240 | 4/1987 | Kessick et al. | 44/604 |

*Primary Examiner*—Carl F. Dees

*Attorney, Agent, or Firm*—Juliusz Szereszewski

[57] ABSTRACT

A method of preparing a sulfur-containing composite fuel is provided to utilize some high-sulfur content solid and semi-solid fuels such as tar sand coke and refinery tank sludges by reducing their sulfur emission on combustion. The method comprises the steps of making an aqueous slurry including a finely divided carbonaceous material, a comminuted sulfur capture agent and an oily agglomeration aid obtained from the refinery or tailing sludges and coagglomerating these components and an optional conditioning agent. The resulting agglomerated composite fuel has a reduced content of inorganic impurities and is suitable for fluidized-bed combustion.

13 Claims, No Drawings

PREPARATION OF COMPOSITE FUELS, WITH REDUCED SULFUR EMISSION CHARACTERISTICS, FROM OILY AND CARBONACEOUS WASTES

The present invention relates to a process for treating oily refinery wastes with high sulfur content such as tank sludges etc., to produce a composite fuel with reduced sulfur emission during combustion or gasification or sulfur-containing fuels, and more particularly, to sulfur-containing carbonaceous composite fuels comprising a sulfur capture agent and to a method of preparing such fuels.

BACKGROUND OF THE INVENTION

Oily wastes or sludges are undesirable by-products of the separation or recovery of bitumen or heavy oils by surface mining or in situ techniques. Stricter environmental regulations have made the disposal of these wastes more difficult. The recovery operations themselves are energy intensive but in order to meet environmental constraints on sulfur emissions it has been necessary to use clean burning natural gas as the fuel. In the long term the cost of natural gas is expected to rise and ancillary fuels will need to be considered. Combustible wastes such as refinery coke or oily sludge offer a potential alternative to natural gas but their high sulfur content makes them unacceptable as a fuel due to the emission of gaseous sulfur compounds, mainly sulfur dioxide. The reduce such emissions, various methods of desulfurizing fuels have been devised to date in an attempt to capture sulfur at the source of combustion rather than to absorb the gaseous sulfur compounds from the flue gas.

U.S. Pat. No. 4,111,755 to Ban et al. discloses a method of producing a pelletized fixed-sulfur coal or coke. A mixture of coal and a sulfur sorbent (limestone) is ground and blended and then balled or compacted to form pellets. The pellets are then subjected to pyrolysis whereby sulfur is fixed in a calcium compound which remains stable in the ash after the pellets are burned as a fuel.

In a process disclosed in U.S. Pat. No. 4,148,613 to Myers, sulfur-containing solid fuel, e.g. coal, is pulverized and then mixed with a finely divided inorganic material by precipitating the inorganic material such as dolomite or hydroxide or carbonate of sodium, potassium, calcium or barium onto the pulverized fuel. The resulting mixture can be formed into pellets or briquettes by agglomeration using binders or adhesives such as coal tar pitch, petroleum pitch or lignin sulphates. The agglomeration step is provided to improve handling, transportation and storage of the fuel pellets.

In Canadian Patent No. 1,200,778, a process was described in which refinery coke or other carbonaceous waste could be used to separate the hydrocarbons from tailings sludges or other oily wastes such as tank sludges. The result of this process was a solid coke-oil agglomerate and a clean aqueous slurry suitable for disposal. The coke-oil agglomerate has a high sulfur content and hence its use as an ancillary fuel is somewhat limited. If a sulfur capture agent could be incorporated into the agglomerate during the sludge cleaning step then a by-product of the process would be a useable fuel which would not require any additional desulfurization treatment, such as flue gas scrubbing, during combustion.

The problem of desulfurizing potential ancillary fuels from a sludge cleaning process has been addressed in the present research. This work has concentrated on the tar sand bitumen and coke produced in the two oil sand plants operating in Alberta, Canada. The coke produced during the upgrading of Athabasca bitumen contains 6–8 % sulfur almost entirely in the form of organic sulfur compounds. The coke produced in these two plants can be referred to as Suncor delayed coke and Syncrude fluid coke.

It has been found that the coagglomeration of sulfur-containing carbonaceous material with a sulfur capture agent can be combined with a sludge cleanup operation also resulting in a concomitant beneficiation of the carbonaceous material through the rejection of inorganic impurities. A composite agglomerated fuel may be obtained that offers a relatively high sulfur capture ability on combustion.

Coal is an exemplary carbonaceous material. Where coal washing operations are conducted, waste coal slurry is usually present which is amenable to coagglomeration with oily sludge (waste) from oil refinery storage tanks to give a composite fuel particularly suitable for fluidized bed combustion.

SUMMARY OF THE INVENTION

The invention provides a composite fuel having reduced sulfur emission on combustion, the fuel comprising a finely divided sulfur-containing carbonaceous material, sulfur capture agent particles and an oily petroleum based agglomeration aid which is capable of wetting the surface of both the carbonaceous material and the sulfur capture agent. The invention also provides a method of preparing such composite fuel, comprising the steps of (a) providing an aqueous slurry including (i) a finely divided solid or semi-solid carbonaceous material, (ii) a finely divided solid sulfur capture agent and (iii) an oily agglomeration aid comprising a hydrocarbon fraction which is capable of wetting the surface of both the sulfur capture agent and the carbonaceous material;

(b) agitating the slurry sufficiently to coagglomerate the carbonaceous material and the sulfur capture agent with the hydrocarbon fraction of the oily agglomeration aid while substantially excluding any hydrophilic inorganic impurities from the carbonaceous material, and (c) separating the agglomerates from the slurry.

Limestone, lime and hydrated lime have been tested and found effective as sulfur capture agents in selected conditions as described hereinbelow.

Although most oils will bind the carbonaceous particles together, only a few are suitable in the aqueous environment for conditioning the surface of the particles of the sulfur capture agent to render them hydrophobic and allow their coagglomeration with the carbonaceous material. This is due to their content of conditioning moieties, e.g. polar groups.

As this invention is aimed at the utilization of oily wastes and sludges, a group of those substances has been investigated and found suitable as the agglomeration aids. The group consisted of refinery storage tank sludges, oil sands tailings, pond sludges, heavy oil emulsions from in situ recovery operations, crude oil contaminated drilling muds, and crude oil contaminated soil from refinery decommissioning.

Another group of oily substances suitable as agglomeration media for the purpose of the invention are heavy oils or pitches including hydrocarbon residues, asphalts, petroleum asphalts, petroleum resins, tar sand bitumens and oils from the hot water processing of tar sands. Naturally, some of those substances require an elevated temperature during the coagglomeration procedure to decrease their viscosity.

For the sake of clarity, oily wastes or sludges as referred to herein are substances containing a hydrocarbon fraction, hydrophilic solids such as clay or silica, and water. A substantial amount of the hydrophilic solids is excluded from the agglomerates due to the method of the invention.

In order to ensure complete agglomeration it is advisable to precondition the sulfur sorbent before coagglomeration with the solid or semi-solid carbonaceous material. For sorbents such as limestone and freshly calcined lime this can be achieved simply by contacting the sorbent with the oily sludge before addition of the carbonaceous phase. In the absence of competition from the highly hydrophobic carbonaceous solid the sorbent has the opportunity to adsorb conditioning components from the oily phase (crude oil, heavy oil or bitumen) thereby rendering its surface hydrophobic. Conditioning occurs by interaction between a chemical entity, such as carboxylic acid, with the calcium atoms of the sorbent material. Additional of the carbonaceous phase then allows coagglomeration with the conditioned sorbent. For the case of slaked lime the sorbent surface is hydrated to such an extent that a more aggressive conditioner must be used. Fatty acids such as oleic or the soluble salt such as sodium oleate are suitable reagents for this purpose. A cheap, readily available source of fatty acids is crude tall oil, a byproduct of chemical paper pulp production. Again best results are obtained if the sorbent is preconditioned before mixing with the carbonaceous solid or semi-solid material.

Although these investigations were carried out with tar sand cokes as carbonaceous materials, the method of the invention should be applicable to other types of high-sulfur fuels such as lignites, peats, coals, petroleum fractions, washery waste coals and some semi-solid petroleum fractions.

Generally the amount of oil necessary to form suitable agglomerates, as related to the total weight of the carbonaceous material and the sulfur sorbent, was 10–25 w/w %. Particularly efficient agglomeration was achieved when the ratio was 15–20 w/w %.

The retention of sulfur dioxide in the ash was found to be dependent on several factors including the calcium to sulfur mole ratio in the agglomerates. Good results were obtained with the ratio in the range from ca. 0.6 to 2.0, still depending on the combustion temperature, or ashing temperature of the composite fuel, the choice of sorbent, the use of conditioning agents and the partial pressure of oxygen on combustion.

It has been found that limestone can be particularly effective as a sulfur capture agent when activated by certain conditioning agents in the aqueous slurry phase. The agents used successfully were sodium hydroxide, sodium oleate and a sodium salt of a petroleum sulfonate. Sulfur capture was improved by 15–30% over limestone alone when the abovementioned conditioning or activating agents, capable of reducing the surface tension in the slurry, were used. The effect was pronounced particularly when the Ca:S mole ratio was in the range 0.6–1.5.

The method of the invention can produce wet agglomerates which are suitable for fluidized bed combustion after drying or without drying, when their water content is ca. 20–35%.

The slurry may be defined as having a solids content of less than 40 wt. %, preferably 10–20% based on the total weight of the slurry.

DETAILED DESCRIPTION OF THE INVENTION

Suncor delayed coke and Syncrude fluid coke were used as carbonaceous material. The coke could be ground or used as in the case of fluid coke. Two different particle sizes, 75–150 μm and 300–500 μm, were tested in this research work. The size of the coke particles did not have any significant effect on its ability to agglomerate in the presence of limestone. Both sizes agglomerated well. The two materials were each coagglomerated with a sulfur dioxide capture agent, or sorbent, selected from line, hydrated lime and limestone. Suncor coker feed sand bitumen was used in most experiments as an agglomeration aid (bridging liquid).

The composition of the coke samples is listed in Table I.

TABLE 1

Composition and physical data for cokes

| Ultimate analysis (dry basis) | Suncor delayed coke | Syncrude fluid coke |
|---|---|---|
| Carbon | 83.0 | 76.8 |
| Hydrogen | 3.4 | 1.6 |
| Nitrogen | 1.5 | 1.5 |
| Sulfur | 5.9 | 6.9 |
| Oxygen | 2.9 | 4.4 |
| Ash | 3.4 | 8.0 |

Lime was a laboratory grade CaO sample. The samples of slaked lime were prepared as shown in Table II>The sample of limestone used was pulverized agricultural limestone (Domtar). It contained approximately 97% $CaCO_3$. A partial size distribution of this sample is given in Table III.

TABLE II

Experimental conditions for various hydrated lime samples

| Sample # | Experimental Conditions |
|---|---|
| 1. | Laboratory grade CaO was mixed with distilled water in the ratio of 1:4 and then air dried at 90° C. |
| 2. | 20 g of CaO was mixed with 80 g of distilled water and 740 ml of isopropyl alcohol. The slurry was then dried at 90° C. on a rotary evaporator under vacuum. |
| 3. | Same as above, except the excess liquid was removed under atmospheric pressure at 90° C. |
| 4. | 10 g of CaO was mixed with 40 g of 0.5% aqueous solution of sodium sulfonate (Witco TRS-10-80) and 370 ml of isopropyl alcohol. Contents were mixed into a slurry and then dried on a rotary evaporator at 90° C. under vacuum. |
| 5. | Same as above, except the excess liquid was removed under atmospheric pressure at 90° C. |
| 6. | Same as sample 1 except that the sample was freeze dried. |
| 7. | Same as sample 1 except that the sample was dried in a vacuum oven at 90° C. |

TABLE III

| Size distribution of limestone sample | |
|---|---|
| Sieve Size (um) | Cumulative Weight Percent Passing |
| 44 | 67.0 |
| 53 | 74.7 |
| 74 | 91.8 |

Combustion of Coke-Oil Agglomerates

Two procedures were used for the washing of dried coke-oil agglomerates. The first procedure involved weighting an agglomerate sample into a porcelain crucible, and placing it into a muffle furnace preset at the desired temperature. The second procedure involved burning a preweighed sample in a bench scale fluidized-bed reactor at 850° C. For the latter procedure, the $SO_2$ concentration in the combustion gases was measured using a Beckmann model 865 $SO_2$ infrared analyzer. Blank experiments were also carried out in which coke-oil agglomerates prepared in the absence of limestone were burned under similar conditions. The results are discussed in the examples.

Agglomeration Procedure 20g of ground coke was mixed with corresponding amounts of ground sorbent depending on the desired Ca:S ratio, and the mixture was dispersed in 100 ml of tap water contained in a Waring Blender. If required, an appropriate amount of a conditioning or activating agent was then added and the contents were agitated at 250 rps for 15 seconds. At this stage the blending speed was lowered to 120 rps. Bitumen was added slowly while continuing blending until discrete agglomerates or a unitary phase was obtained (5–15 minutes). Coke-oil agglomerates/oil phase were then separated from the aqueous phase by screening. A portion of the agglomerates was used for analysis of bitumen, coke and ash content. The rest was dried at 100° C. to a constant weight. The coke-oil agglomerates before drying contained about 20–35% water.

Sulfur analysis

Sulfur contents of coke and coke agglomerates were determined by three methods for comparison: ASTM method D4239-83, Leco sulfur analyzer, and x-ray fluorescence spectrometry. The latter method gave values which were closest to the expected sulfur content. Hence, all the results discussed herein are based on the x-ray spectrometry method.

EXAMPLE 1

100 g of a storage tank sludge from a heavy oil project (bitumen content≈14%) was agitated with 50 g of Syncrude coke (ratio of coke to bitumen≈3.5:1) to recover residual oil according to our Canadian patent No. 1,200,778. Coke-oil agglomerates thus obtained were divided into two portions. One portion was first dried at 100° C. followed by ashing at 900° C. in a muffle furnace. The other portion was reslurried and then coagglomerated with 15% Domtar agricultural limestone so as to give a Ca to sulfur ratio of 1.1:1. These agglomerates were fist dried and then ashed at 900° C. as above. Total sulfur in both agglomerate samples and their ashed samples was determined using x-ray fluorescence spectroscopy. The results are shown in the Table IV below.

TABLE IV

| $SO_2$ Capture by Limestone | | | |
|---|---|---|---|
| Run # | Sample | w/w % of Sulfur | $SO_2$ Capture (As w/w % of total Sulfur in the feed) |
| 1 | Coke-Oil Agglomerates | 3.62 | — |
| 2 | Ash from Above | 0.46 | 5.0 |
| 3 | Coke-oil-15% limestone Agglomerates | 3.33 | — |
| 4 | Ash from Above | 7.65 | 98.8 |

The coagglomeration was carried out in two steps to facilitate the determination of CA:S ratio. Normally the sulfur adsorbent would be incorporated into the agglomerate during the oil collection stage.

The agglomeration method as described above thus provides a means of cleaning waste sludges and tailings of oil while producing an oil enriched solid fuel with good sulfur capture efficiency. This whole process can be achieved in a series of simple mixing steps. The resulting oil-cokesorbent agglomerates can be used as an ancillary fuel for steam generation in conventional burners without modification for sulfur dioxide capture such as flue gas scrubbers.

EXAMPLE 2

Samples of Suncor and Syncrude coke oil agglomerates with and without the presence of Domtar limestone were prepared as described under "Agglomeration Procedure". These samples were burnt in a bench scale fluidized bed reactor of 850° C. with air flow rate of 15 litres per minutes. Combustion tests were also carried out in a muffle furnace at 900° C. The results of these tests are listed in Table V.

TABLE V

| $SO_2$ Capture by Limestone - Muffle furnace vs. Fluidized-bed Combustion | | | | |
|---|---|---|---|---|
| | Percent, $SO_2$ capture | | | |
| | Syncrude coke | | Suncor coke | |
| Ca:S molar ratio | Muffle furnace | FB-reactor | Muffle furnace | FB-reactor |
| 0 | 5 | — | 2 | — |
| 1 | 76 | 68 | 77 | 54 |

Because of the considerably shorter retention time in a fluidized bed combustor compared with a muffle furnace, and the lack of recirculation capability, the results from the two systems are not directly comparable. This explains the lower sulfur capture in a fluidized bed combustor compared to that in a muffle furnace. However, combustion in a recirculating fluidized bed reactor is expected to give comparable results to those obtained from a muffle furnace.

The difference in the extent of sulfur capture from the two cokes as noted from the fluidized bed combustion results, can be explained on the basis of the differences in the reactivities of the two cokes. On combustion, more reactive Suncor coke will release $SO_2$ faster compared with the less reactive Syncrude coke. Thus the contact time of $SO_2$ with the sorbent will be much shorter for Suncor coke than for Syncrude coke, resulting in a greater utilization of the sorbent for Syncrude coke than for Suncor coke.

EXAMPLE 3

Coke-oil agglomerates containing a quantity of Domtar limestone corresponding to Ca:S molar ratio of 1:1 were prepared according to the procedure described under "Agglomeration Procedure". Half of the samples were first dried in the oven and then burnt in a bench scale fluidized bed reactor at 850° C. while maintaining the air flow at 15 litres per minute. The other half of the sample was burnt wet in the fluidized bed combustor under similar conditions. The results are given in the Table VI below.

TABLE VI

The effect of moisture on the capture of $SO_2$ by limestone

| Description | Sulfur Capture (As w/w % of total Sulfur) Syncrude Fluid Coke | Suncor Delayed Coke |
|---|---|---|
| 1 mm Size dry agglomerates | 67.6 | 54.4 |
| 1 mm Size wet[1] agglomerates | 59.1 | 59.4 |

[1]Water content: Suncor coke agglomerates, 35%; Syncrude coke agglomerates, 20%.

Although the presence of moisture did not appear to affect the combustion efficiency of the agglomerates, it did interfere in the analysis of $SO_2$ by the infrared analyzer. The difference in the sulfur capture results from the dry and wet agglomerates falls within 5–7% range for both cokes. Considering the analytical errors due to the presence of moisture it can be assumed that comparable levels of sulfur dioxide sorption are obtained from both wet and dry agglomerates.

EXAMPLE 4

Samples of coke-oil agglomerates containing varied proportions of Domtar limestone were prepared according to the procedure described under "Agglomeration Procedure". Combustion tests were carried out on the dried samples in the bench scale fluidized bed combustor at 850° C. while maintaining the air flow at 15 litres per minute. The results of these tests are listed in Table VII below.

TABLE VII

The effect of increased quantities of limestone

| Ca:S Mole Ratio | Percent, $SO_2$ capture Syncrude Coke | Suncor Coke |
|---|---|---|
| 0.85 | 58.6 | — |
| 0.89 | — | 46.5 |
| 1.00 | 67.6 | 54.4 |
| 1.50 | 64.1 | 44.7 |
| 2.00 | 68.1 | 54.4 |

The results of Table VII demonstrate the effect of Ca to S mole ratio on the retention of sulfur by limestone. Contrary to our investigations in a muffle furnace and to the conventional fluidized bed combustion studies involving physical mixtures, increased quantities of limestone were not beneficial beyond the ratio of Ca:S of 1:1. Maximum limestone utilization was achieved for a limestone quantity corresponding to the Ca:S mole ratio of 1:1. Increasing the load of limestone beyond this amount resulted either in a decreased $SO_2$ sorption or no further improvement. This can be explained on the basis of the dominance of calcination reaction with increasing amounts of limestone in the agglomerates. Increased $CO_2$ pressure from the calcination of limestone will result in the breakage of agglomerates and thus less contact time between $SO_2$ and the sorbent. However, if this is true then the use of lime should give better results.

EXAMPLE 5

Samples of coke-oil agglomerates containing varying amounts of calcined limestone were prepared according to the Procedure described under "Agglomeration Procedure". Combustion tests were carried out on these samples in the fluidized bed reactor as described in Example 4. The results are listed in Table VIII.

TABLE VIII

The effect of increased quantities of lime in a fluidized-bed reactor

| Ca:S mole ratio | Percent, $SO_2$ capture |
|---|---|
| 0 | — |
| 0.5 | 55 |
| 1.0 | 71 |
| 1.5 | 75 |
| 2.0 | 83 |

The results in Table VIII demonstrate the effect of the increased amounts of lime on the reduction of $SO_2$ emissions from the combustion of Syncrude coke. The degree of sulfur dioxide retention increases with increasing amounts of lime. These results are consistent with the above given explanation for the observed adverse effect of the increased amounts of limestone.

Results and Discussion

The $SO_2$ capture rate was found to be dependent on the sorbent content for the static combustion tests (muffle furnace). Table IX shows, for Suncor coke and limestone, a decrease in sulfur dioxide emission with an increased limestone content of the agglomerates. The $SO_2$ capture rate, however, becomes almost constant above Ca:S mole ratio of 1:1 at a temperature of 460° C. At the higher ashing temperature (1000° C.) and under higher partial pressures of $CO_2$ (limited air), a higher percent of $SO_2$ capture was found.

TABLE IX

Ca:S ratio effect on $SO_2$ capture by limestone in the absence of a conditioning agent

| Ca:S mole ratio | Percent, $SO_2$ capture: Ashing temp. 460°, excess air, muffle furnace | Ashing temp. 1000°, limited air muffle furnace |
|---|---|---|
| 0.5 | 26 | 50 |
| 1.0 | 53 | 68 |
| 1.5 | 57 | 75 |
| 2.0 | 58 | 80 |
| 2.5 | 58 | 79 |

The effect of Ca:S mole ratio on the retention of sulfur dioxide by lime is illustrated in Table X. These tests were carried out by preparing the samples in the presence of 0.25% sodium oleate and burning the samples in a muffle furnace. It is evident that the degree of sulfur dioxide retention increases with increasing amounts of lime in the agglomerates up to about 90% at a calcium to sulfur mole ratio of about 2:1. Maximum sulfur dioxide retention was obtained new 750° C. in contrast to a value of 1000° C. for limestone. This is consistent with other published data regarding optimum sulfation temperature.

TABLE X

Ca:S mole ratio effect on the retention of $SO_2$ by Suncor coke samples containing lime

| Ca:S mole ratio | Percent, $SO_2$ capture |
|---|---|
| 0 | 2 |
| 1.0 | 72 |
| 2.0 | 87 |
| 3.0 | 90 |

TABLE X-continued

| Ca:S mole ratio effect on the retention of $SO_2$ by Suncor coke samples containing lime | |
|---|---|
| Ca:S mole ratio | Percent, $SO_2$ capture |
| 4.0 | 89 |

Table XI shows the effect of Ca:S mole ratio on the $SO_2$ retention by samples containing hydrated lime and Suncor coke. Sample preparation and combustion procedure was similar to that described above.

TABLE XI

| Calcium to sulfur ratio effect on $SO_2$ capture by hydrated lime | |
|---|---|
| Ca:S mole ratio | Percent, $SO_2$ capture |
| 0 | 2 |
| 0.5 | 38 |
| 1.0 | 70 |
| 1.5 | 99 |
| 2.0 | — |

TABLE XII

| $SO_2$ Capture Efficiencies of Limestone vs Lime for Syncrude Coke | | |
|---|---|---|
| | Percent, $SO_2$ capture | |
| Ca:S mole ratio | Limestone | Lime |
| 0 | 5 | 5 |
| 0.5 | 50 | 30 |
| 1.0 | 94 | 70 |
| 1.5 | 95 | 86 |
| 2.0 | 95 | 87 |

Coke to bitumen ratio did not appear to affect the reactivity or capacity of hydrated lime for $SO_2$ capture. This suggests that hydrated lime is an effective sorbent for sulfur dioxide for bitumen as well as from coke.

Contrary to the findings noted for CaO and limestone, the presence of excess air does not have any significant effect on the overall retention of sulfur dioxide by hydrated lime.

In order to assess the efficiency of this process for controlling sulfur dioxide emissions from the combustion of various types of cokes, coagglomeration of Syncrude fluid coke with lime or limestone was also attempted. The results were essentially identical to those observed for Suncor coke. The efficiencies of sulfur dioxide retention from the combustion (muffle furnace) of Syncrude coke by limestone and lime can be compared with the results presented in Table XII. Although both curves follow essentially the same trend, it is obvious from the results that limestone is a more efficient sorbent, compared with lime, over the entire range of calcium to sulfur ratios. This could be attributed to the higher porosity and reactivity produced by the in situ calcination reaction. The effect of the pore size is known to be significant in determining the rate as well as the extent of reaction between $SO_2$ and CaO. It has been found that small pores in the calcines resulted in high rates of reactions and low overall conversions due to pore plugging, while large pores caused lower rates of reaction with higher conversions. It is probable that the freshly calcined limestone particles have bigger pores than the CaO used. This is a very important result as the ability to use a cheap and readily available material in its natural form has a considerable economic significance. The cost ratio of lime to limestone on a molar basis may vary from 2 to 4 depending on the transportation distance. Even the costs for transportation and handling of limestone tend to be lower than for lime since it can be transported in open trucks.

The effect of some conditioning or activating agents on sulfur dioxide capture by limestone-containing agglomerates was investigated. The agents tested were sodium hydroxide, sodium oleate and Witco TRS 10/80, a sodium salt of a petroleum sulfonate (Table XIII). The addition of all three agents in the slurry stage of the agglomeration procedure improved the coagglomeration of the components, resulting in enhanced and more reproducible desulfurization, especially at higher Ca:S mole ratios. This could have been due to the improved wettability of the components towards the bridging oil as a result of the use of surfactants or by in situ formation of surfactants. It appears that the three additives all have the ability to distribute limestone uniformly within the agglomerates.

Overall sulfur capture by limestone was independent of the concentration of these conditioning agents. This is consistent with the presumed catalytic nature of these additives.

TABLE XIII

| Effect of various conditioning agents on the retention of $SO_2$ by limestone | | | | |
|---|---|---|---|---|
| | Percent, $SO_2$ capture | | | |
| Ca:S mole ratio | Blank | NaOH | Sodium oleate | TRS 10/80 |
| 0 | 2 | 2 | 2 | 2 |
| 0.5 | 48 | 48 | 50 | 50 |
| 1.0 | 65 | 80 | 78 | 78 |

Sodium oleate was found to be beneficial in the agglomeration of laboratory prepared samples of hydrated lime, but none of the other agents affected either the retention of $SO_2$ or agglomeration in the presence of reagent grade $Ca(OH)_2$.

It has been established that all the three sorbents investigated: lime, hydrated lime and limestone, particularly in the presence of conditioning agents, are efficient in their capacity to retain $SO_2$ on combustion of the agglomerates. Comparative tests were conducted for Suncor coke-based agglomerates, wherein limestone, lime and hydrated lime were conditioned as discussed above. $SO_2$ capture efficiencies of ca. 80–90% were obtained (Tables XIV and XV), but activated limestone was still found to be the most efficient. This is of considerable significance since limestone is less expensive than the other sorbents.

TABLE XIV

| Comparative $SO_2$ capture efficiencies of various sorbents with Suncor coke | | | |
|---|---|---|---|
| | Percent, $SO_2$ Capture | | |
| Ca:S mole ratio | Lime | Limestone | Hydrated Lime |
| 0 | 2 | 2 | 2 |
| 0.5 | 41 | 47 | 37 |
| 1.0 | 71 | 77 | 71 |
| 1.5 | 87 | 90 | 90 |
| 2.0 | 95 | — | — |

Lime and hydrated lime both have comparable efficiencies for low calcium to sulfur ratio (up to $\approx$1:1). However, in the range of Ca to S ratios beyond 1:1, hydrated lime appears to be more efficient than lime, approaching in efficiency that observed for activated limestone.

TABLE XV

| Efficiency of $SO_2$ Capture, Suncor coke vs Syncrude coke | | |
|---|---|---|
| | Percent, $SO_2$ capture | |
| Ca:S mole ratio | Suncor coke | Syncrude coke |
| 0 | 2 | 5 |
| 0.5 | 45 | 60 |
| 1.0 | 77 | 84 |
| 1.5 | >90 | >90 |
| 2.0 | — | — |

A comparison of the efficiency of this process in terms of sulfur retention by the ash has been made for the two cokes investigated. It is obvious that although this process is effective for both cokes it is slightly more efficient of Syncrude coke especially at higher calcium to sulfur ratios. Thus, at a calcium to sulfur mole ratio of about 1;1, over 90% sulfur retention can be achieved for Syncrude coke compared with over 80% sulfur retention for Suncor coke. This difference may be due to the reportedly higher bulk gasification reactivity of Syncrude fluid coking coke compared with that of Suncor delayed coking coke. Higher reactivity of fluid coke, compared with delayed coke, is surprising as the former was subjected to more severe treatment in the coking process. However, no reason for this reactivity difference has be suggested.

This size of agglomerates can be controlled to suit the particular application of the composite fuel. For fluidized bed combustion, the size of agglomerates should be in the range 0.5 to 3 mm; for bubbling bed, about 4 to 5 mm, while for combustion in a nozzle burner, their size should not exceed 0.5 mm.

The size of agglomerates is in direct proportion to the oil content. The size also increases with longer agitation periods, while the degree of agitation has a reverse effect, i.e. the agglomerates tend to decrease in size when the agitation is more vigorous.

We claim:

1. A method of preparing a composite agglomerated fuel having reduced sulfur emission on combustion, comprising the steps of:

(a) providing an aqueous slurry including (i) a finely divided solid or semi-solid carbonaceous material, (ii) a finely divided solid sulfur capture agent, (iii) an oily agglomeration aid comprising a hydrocarbon fraction which, has sufficient polar groups to be capable of wetting the surface of both the sulfur capture agent and the carbonaceous material, and (iv) a conditioning, or activating agent capable of reducing the surface tension of the slurry, said agent being selected from the group consisting of sodium hydroxide, sodium oleate and a sodium salt of a petroleum sulfonate, (b) agitating the aqueous slurry sufficiently to co-agglomerate the carbonaceous material and the sulfur capture agent with the hydrocarbon fraction of the oily agglomeration aid while substantially excluding any hydrophilic inorganic impurities from the carbonaceous material, and (c) separating the agglomerates from the slurry.

2. The method of claim 1 wherein the hydrocarbon fraction contains sufficient polar groups to facilitate wetting of the surface of the sulfur capture agent.

3. The method of claim 1 wherein the agglomeration aid is an oily sludge selected from the group consisting of refinery storage tank sludges, oil sands tailings pond sludges, heavy oil emulsions from in situ recovery operations, crude oil contaminated drilling muds, and crude oil contaminated soil from refinery decommissioning.

4. The method of claim 1 wherein the agglomeration aid is a heavy oil or pitch selected from the group consisting of hydrocarbon residue, asphalts, petroleum asphalts, petroleum resins, tar sand bitumens and oil from the hot water processing of tar sands.

5. The method of claims 1 wherein the amount of the hydrocarbon fraction ranges from about 10 to about 25 w/w % based on the total weight of the carbonaceous material and the sulfur capture agent in the agglomerates.

6. The method of claims 1 wherein the solids content in the slurry is less than 40 wt. %, preferably 10–20% based on the total weight of the slurry.

7. The method of claim 1 wherein the sulfur capture agent is selected from lime, hydrated lime or limestone.

8. The method of claim 7 wherein the mole ratio of calcium in the sulfur capture agent to sulfur in the agglomeration ranges from about 0.6 to 2.0.

9. The method of claim 1, wherein the carbonaceous material is selected from a group consisting of tar sand refinery coke, lignites, coals, washery waste coals, peats and heavy semi-solid petroleum fractions.

10. The method of claim 1 wherein a tar sand refinery coke and a tar sand bitumen are co-agglomerated with a sulfur capture agent.

11. The method of claim 8, wherein the sulfur capture agent is limestone.

12. The method of claim 1 wherein the finely divided carbonaceous material has a particle size of ca. 75–500 μm.

13. A composite agglomerate fuel comprising a finelydivided sulfur-containing carbonaceous material substantially free of inorganic impurities, sulfur capture agent particles and an oily petroleum based agglomeration aid, the surface of both the carbonaceous material and of the sulfur captive agent particles being wetted by the agglomeration aid, the fuel obtained by the steps of:

(a) providing an aqueous slurry including (i) a finely divided solid or semi-solid carbonaceous material (ii) a finely divided solid sulfur capture agent, (iii) an oily agglomeration aid comprising a hydrocarbon fraction which has sufficient polar groups to be capable of wetting the surface of both the sulfur capture agent and the carbonaceous material, and (iv) a conditioning, or activating agent capable of reducing the surface tension of the slurry, said agent being selected from the group consisting of sodium hydroxide, sodium oleate and a sodium salt of a petroleum sulfonate.

* * * * *